United States Patent [19]

Yokoya et al.

[11] Patent Number: 5,063,129

[45] Date of Patent: Nov. 5, 1991

[54] ELECTROPHOTOGRAPHIC PRINTING PLATE PRECURSOR

[75] Inventors: Hiroaki Yokoya; Hiromichi Tachikawa; Syu Watarai, all of Kanagawa, Japan

[73] Assignee: Fuji Photo Film Co., Ltd., Kanagawa, Japan

[21] Appl. No.: 449,161

[22] Filed: Dec. 13, 1989

[30] Foreign Application Priority Data

Dec. 15, 1988 [JP] Japan ..... 63-317318
Jan. 18, 1989 [JP] Japan ..... 1-9501

[51] Int. Cl.[5] ..... G03G 15/09; G03G 15/00; G03G 13/28

[52] U.S. Cl. ..... 430/83; 430/56; 430/49

[58] Field of Search ..... 430/56, 83, 49

[56] References Cited

U.S. PATENT DOCUMENTS 4,461,821 7/1984 Sano et al. ..... 430/83
4,500,622 2/1985 Horie et al. ..... 430/83 X
4,500,623 2/1985 Sano et al. ..... 430/83
4,882,248 11/1989 Yamada et al. ..... 430/49

*Primary Examiner*—Marion E. McCamish
*Assistant Examiner*—Stephen C. Crossan
*Attorney, Agent, or Firm*—Sughrue, Mion, Zinn Macpeak & Seas

[57] ABSTRACT

A electrophotographic printing plate precursor comprising an electrically-conductive support having thereon a photoconductive layer containing at least photoconductive pigments and a binder resin, wherein said photoconductive pigments are phthalocyanine pigments and said photoconductive layer further comprises a compound represented by the general formula (I), (II) or (III):

(I)

wherein Z represents a sulfur or oxygen atom; Ar represents a monovalent aromatic hydrocarbon group or monovalent heterocyclic group; $R_3$ represents a hydrogen atom, alkyl group, aryl group or aralkyl group; Ar and $R_3$ may together form a ring; and $R_1$ and $R_2$, which may be the same or different, each represents an alkyl group, aryl group or aralkyl group, with the proviso that the aromatic hydrocarbon group and heterocyclic group represented by Ar and the alkyl, aryl and aralkyl group represented by $R_1$, $R_2$ and $R_3$ may be further substituted by substituents, (II)

(III)

wherein Z represents a sulfur or oxygen atom; $R_4$ to $R_9$, which may be the same or different, each represents a hydrogen atom, alkyl group, aryl group or monovalent group derived from heterocyclic group; $R_4$ and $R_5$ or $R_6$ and $R_7$ may be connected to each other; $R_4$ to $R_7$ may be connected to each other to form a crosslinkable ring as a whole in the general formula (II); and $R_{10}$ represents a divalent arylene, aralkylene, polymethylene or alkylene group.

9 Claims, 2 Drawing Sheets

ELECTROPHOTOGRAPHIC PRINTING PLATE PRECURSOR

FIELD OF THE INVENTION

The present invention relates to a novel electrophotographic printing plate precursor with an improved electrophotographic sensitivity having a photoconductive layer comprising a phthalocyanine pigment as a photoconductive pigment which is designed to undergo an electrophotographic process whereby a toner image is formed and the resulting nonimage portion other than the toner image portion is then removed (hereinafter referred to as "etching") to form a printing plate.

BACKGROUND OF THE INVENTION

PS plates comprising a positive type sensitizing agent containing a diazo compound and a phenolic resin as main components or a negative type sensitizing agent containing an acrylic monomer or prepolymer as main component have heretofore been put into practical use as lithographic offset printing plate precursors. However, since all these printing plate precursors have a low sensitivity, these printing plate precursors are exposed to light through a film original on which an image had been previously recorded brought into close contact therewith to form printing plates. On the other hand, the progress of computer image processing techniques and large capacity data storage and communication techniques have recently enabled a continuous computer based operation including original input, correction, editing, layout and paging. With this computer operation, an electronic editing system capable of instantly outputting data to terminal plotters via a high speed communications network or satellite communications network has been put into practical use. In particular, such an electronic editing system is in great demand in the field of newspaper printing requiring instantaneity. Furthermore, in the field of printing wherein a printing plate is reproduced as necessary based on an original stored in the form of film original, a tendency will be growing that originals are stored as digital data in very large capacity recording media such as optical disc which will be developed.

However, little or no direct type printing plate precursors designed to directly receive data from the output of terminal plotters to form a printing plate have been put into practical use. Even in stations where an electronic editing system is operated, data is outputted to a silver salt system photographic film. PS plates are then exposed to light through the silver salt system photographic film brought into contact therewith to form printing plates. One of the reasons for the above described conditions is that it is difficult to provide a direct type printing plate precursor having sufficient sensitivity to form a printing plate within a practical period of time by a light source in the output plotter (e.g., He-Ne laser, semiconductor laser).

An electrophotographic photoreceptor can be a light-sensitive material having a light sensitivity high enough to provide a direct type printing plate. Many electrophotographic printing plate precursors of the type wherein a photoconductive layer in the nonimage portion is removed after the formation of toner image have already been known. Examples of such electrophotographic printing plate precursors include those described in JP-B-37-17162, JP-B-38-6961, JP-B-38-7758, JP-B-41-2426 and JP-B-46-39405 (the term "JP-B" as used herein means an "examined Japanese patent publication"), and JP-A-50-19509, JP-A-50-19510, JP-A-52-2437, JP-A-54-145538, JP-A-54-134632, JP-A-55-105254, JP-A-55-153948, JP-A-55-161250, JP-A-56-107246, JP-A-57-147656 and JP-A-57-161863 (the term "JP-A" as used herein means an "unexamined published Japanese patent application").

JP-A-56-107246 discloses an electrophotographic printing plate precursor prepared by a process which comprises adding an oxazole compound as an organic photoconductive compound to a binder resin soluble in an alkali or aqueous alcohol solution, adding a sensitizing dye to the mixture, and then coating the material on an aluminum plate as a photo-conductive layer. JP-A-56-146145 discloses an electrophotographic printing plate precursor comprising an oxadiazole compound as an organic photoconductive compound, a condensed polycyclic quinone pigment as a charge generating agent and an alkali-soluble carboxyl group-containing polymer. JP-A-62-54266 discloses an electrophotographic printing plate precursor comprising a hydrazone compound as an organic photoconductive compound and a pigment or dye such as phthalocyanine pigment or quinacridone pigment and an aqueous or alcohol solvent-soluble binder resin as charge generating agents.

Thus, in order to use an electrophotographic photoreceptor as a printing plate, it is normally necessary to remove the nonimage portion with an alkaline etching solution to allow the hydrophilic surface to be exposed. Therefore, as a binder resin there is often used a binder resin which is dissolved in or swells in an alkaline solvent to undergo elimination. However, as compared to polycarbonate resins which have been widely used as binder resins for electrophotographic photoreceptors, such a resin which is dissolved in or swells in an alkaline solvent is normally poor in the compatibility with any organic photoconductive compound such as oxazole, hydrazone, oxadiazole and pyrazoline. This causes a problem that when such an organic photoconductive compound is dissolved and incorporated in a printing plate, it is separated and deposited thereon with time. Furthermore, since such an organic photoconductive compound has a poor solubility in an etching solution and thus lacks elutability by an etching solution in the nonimage portion, stains are observed in the white background of the resulting printed matter.

Moreover, an electrophotographic printing plate precursor comprising such an organic photographic compound normally has poor chargeability and capability of retaining electric charge in dark places as set forth in Examples of the present invention. Therefore, the potential contrast (potential difference) between the image portion and the nonimage portion is lowered, causing some troubles in toner development or some restrictions in the time between charging and development. This results in the formation of an electrophotographic printing plate precursor with a poor practicality. Thus, an electrophotographic printing plate precursor comprising an organic photoconducting compound soluble in a binder resin has many disadvantages.

On the other hand, an electrophotographic printing plate precursor free of such an organic photoconductive compound soluble in a binder resin is known. Such an electrophotographic printing plate precursor comprises a photoconductive layer having an organic photoconductive pigment such as a phthalocyanine pigment dispersed in a binder resin soluble in an alkaline or alcohol aqueous solution. For example, an electrophotographic printing plate precursor comprising an aluminum plate having thereon a photoconductive layer having a phthalocyanine pigment dispersed in a phenolic resin is disclosed in JP-A-55-105254 and JP-A-55-161250. However, such an electrophotographic printing plate precursor is disadvantageous in that it lacks sensitivity. Thus, it is known that an electrophotographic photoreceptor comprising a phthalocyanine pigment dispersed in a binder resin and free of an organic photoconductive compound such as a hydrazone compound or oxazole compound exhibits an induction effect which causes a drop in the sensitivity (Weigl, "Current Problems in Electrophotography"- P278, Walter de Gruyter, 1972). It is also known that the incorporation of an electrophilic compound such as tetranitrofluorenone or trinitrofluorenone in such a photoreceptor enables a reduction in the induction effect and an improvement in sensitivity ("Denshi Shashin Gakkaishi" 60, 116, 20, 1982). However, such an electrophilic compound is toxic and can hardly be put into practical use.

As mentioned above, it has been desired to provide an elecrophotographic printing plate precursor with a high sensitivity, no aging deterioration and an excellent elutability by an etching solution.

SUMMARY OF THE INVENTION

It is therefore an object of the present invention to provide an electrophotographic printing plate precursor with a high sensitivity, a high aging stability, an excellent elutability and less stain.

The above and other objects of the present invention will become apparent from the following detailed description and examples.

These objects of the present invention are accomplished with an electrophotographic printing plate precursor comprising an electrically-conductive support having thereon a photoconductive layer containing at least photoconductive pigments and a binder resin which is designed to undergo an electrophotographic process wherein a toner image is formed and the photoconductive layer in the nonimage portion other than the toner image portion is then removed to form a printing plate, wherein said photoconductive pigments are phthalocyanine pigments and said photoconductive layer further comprises a compound represented by the general formula (I), (II) or (III):

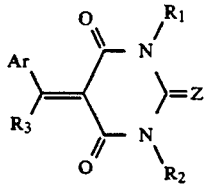

(I)

wherein Z represents a sulfur or oxygen atom; Ar represents a monovalent aromatic hydrocarbon group or monovalent heterocyclic group; $R_3$ represents a hydrogen atom, alkyl group, aryl group or aralkyl group; Ar and R: may together form a ring; and $R_1$ and $R_2$, which may be the same or different, each represents an alkyl group, aryl group or aralkyl group, with the proviso that the aromatic hydrocarbon group and heterocyclic group represented by Ar and the alkyl, aryl and aralkyl group represented by $R_1$, $R_2$ and $R_3$ may be further substituted by substituents.

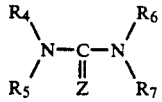

(II)

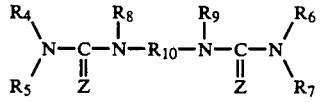

(III)

wherein Z represents a sulfur or oxygen atom; $R_4$ to $R_9$, which may be the same or different, each represents a hydrogen atom, alkyl group, aryl group or monovalent group derived from a heterocyclic group each of which groups may be further substituted by substituents; $R_4$ and $R_5$ or $R_6$ and $R_7$ may be connected to each other; $R_4$ to $R_7$ may be connected to each other to form a crosslinkable ring as a whole in the general formula (II); and $R_{10}$ represents a divalent arylene or aralkylene group which may be further substituted by substituents or a divalent polymethylene or alkylene group.

BRIEF DESCRIPTION OF THE DRAWINGS

By way of example and to make the description more clear, reference is made to the accompanying drawings in which.

DETAILED DESCRIPTION OF THE INVENTION

Figure 1:
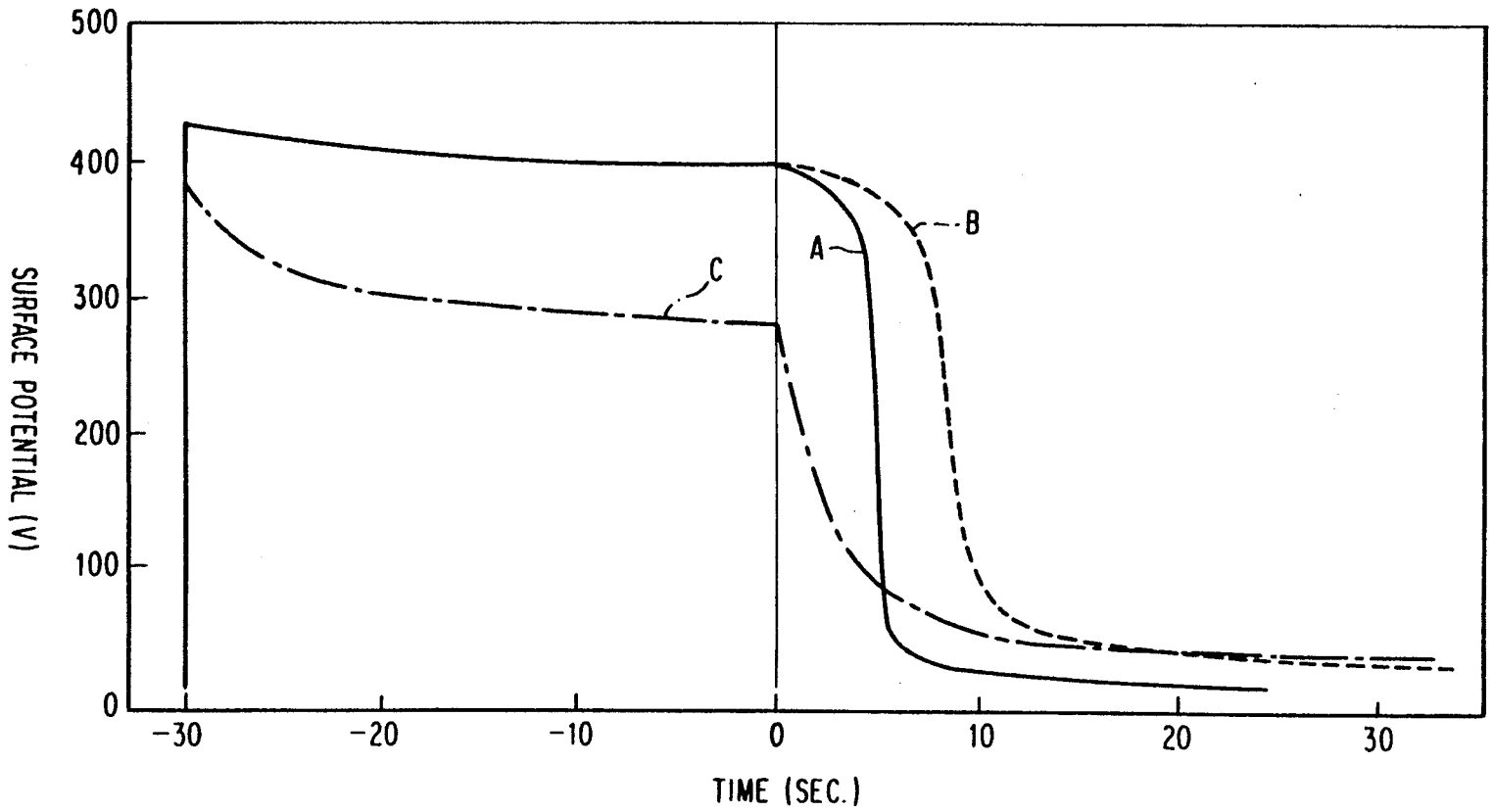
FIGS. 1 and 2 indicate surface potential attenuation curves of electrophotographic printing plate precursors wherein Curves A, B and C in FIG. 1 indicate surface potential attenuation of printing plate precursors in Examples 1, and Comparative Examples 1 and 2, respectively, and Curves A', B and C in FIG. 2 indicate surface potential attenuation of printing plate precursors in Example 2 and Comparative Examples 1 and 2, respectively.

The first component which constitutes the photoconductive layer in the present electrophotographic printing plate precursor is a phthalocyanine pigment as a photo-conductive pigment. Phthalocyanine pigments are present in various forms. For example, phthalocyanine pigments may contain different central metals or have different crystal forms. Some phthalocyanine pigments may contain substituents in the benzene ring. As such central metals there have been known copper, nickel, iron, vanadium, aluminum, gallium, indium, silicon, titanium, magnesium, cobalt, platinum, germanium, etc. Phthalocyanine pigments may contain no central metals. As crystal forms of phthalocyanine pigments there have been known various crystal forms observed by X-ray crystalodiffraction on metal-containing phthalocyanines and metal-free phthalocyanines. For copper-containing phthalocyanines, polymorphism such as $\alpha$ type, $\beta$ type, $\gamma$ type, $\delta$ type, $\epsilon$ type, $\eta$ type, and $\rho$ type have been known. For metal-free phthalocyanines, polymorphism such as $\alpha$ type, $\beta$ type, $\chi$ type, and $\tau$ type have been known. For titanylphthalocyanines, polymorphism such as $\alpha$ type, $\beta$ type and m type have been known. In addition, substituted phthalocyanines having benzene rings substituted by halogen atoms such as fluorine, chlorine and bromine, or alkyl group, carboxyl group, amido group, sulfonyl group or other substituents have been known. Examples of such phthalocyanines include metal-free phthalocyanines as described in JP-B-44-14106, JP-B-45-8102, JP-B-46-42511, JP-B-46-42512 and JP-B-49-4338, and JP-A-58-182639 and JP-A-62-47054, copper-containing phthalocyanines as described in JP-A-50-38543, JP-A-50-95852, JP-A-51-108847 and JP-A-51-109841, titanyl phthalocyanines as described in JP-A-59-49544, JP-A-59-166959, JP-A-62-275272, JP-A-62-286059, JP-A-62-67094, JP-A-63-364, JP-A-63-365, JP-A-63-37163, JP-A-63-57670, JP-A-63-80263, JP-A-63-116158 and JP-A-63-198067, aluminum-containing phthalocyanines as described in JP-A-57-90058, JP-A-62-163060, JP-A-62-133462, JP-A-62-177069, JP-A-63-73529 and JP-A-63-43155, vanadyl phthalocyanines as described in JP-A-57-146255, JP-A-57-147641 and JP-A-57-148747, and halogenated metal-containing phthalocyanines as described in JP-A-59-44053, JP-A-59-128544, JP-A-59-133550, JP-A-59-133551, JP-A-59-174846, JP-A-59-174847, JP-A-60-59354, JP-A-60-260054, JP-A-60-220958, JP-A-62-229254, JP-A-63-17457, JP-A-59-155851, JP-A-63-27562 and JP-A-63-56564. However, the present invention should not be construed as being limited to these compounds. Various known phthalocyanines can be used in the present invention. These phthalocyanines have different absorption wavelength ranges and are properly selected depending on the purpose of application. For electrophotographic application, studies have been extensively made to provide phthalocyanine pigments having absorption in the wavelength suited to 780-nm to 830-nm semiconductor lasers. In the present invention, all these known phthalocyanine pigments can be used.

Electrophotographic printing plate precursors are often required to maintain more electric charge than electrophotographic photoreceptors for copiers or photoreceptors for optical printers. Therefore, phthalocyanine pigments which can maintain much electric charge (surface potential in darkroom) are preferably used in the present invention. As such phthalocyanine pigments there can be used copper-containing phthalocyanines and metal-free phthalocyanines. For writing by a semiconductor laser, $\epsilon$ type copper-containing phthalocyanines as disclosed in JP-A-50-38543 and x type metal-free phthalocyanines as disclosed in JP-B-48-34189 can be preferably used.

The content of such a phthalocyanine pigment in the photoconductive layer is in the range of 3 to 50% by weight, preferably 5 to 30% by weight based on the weight of solid content in the photoconductive layer.

The second component in the present invention is a binder resin. As such a binder resin there can be used a resin which doesn't elute in the toner image portion and is soluble in or swellable with a solvent which elutes the nonimage portion (i.e., photoconductive layer). A resin which is soluble in or swellable with an alcohol and/or alkaline aqueous solution is preferably used. Examples of such a resin include phenolic resin, styrene-maleic anhydride copolymer, vinyl acetate, crotonic acid copolymer, vinyl acetate-maleic anhydride copolymer, alcohol-soluble nylon, and bipolymer or higher copolymer of a monomer containing an acid group such as acrylic acid, methacrylic acid, crotonic acid or itaconic acid with a monomer such as methacrylic ester, acrylic ester or styrene. Any copolymer containing an acidic group can be used in the present invention. There can be more preferably used copolymers as described in Japanese Patent Application Nos. 87024/88, 156387/88 and 158365/88. These copolymers will be described below.

(a) Copolymer comprising at least one acrylic ester or methacrylic ester containing an aromatic ring as a monomer component and at least one vinyl-polymerizable monomer containing an acidic functional group as a monomer component.

(b) Copolymer comprising at least one vinyl ester compound containing an aromatic ring as a monomer component and at least one vinyl-polymerizable monomer containing an acidic functional group as a monomer component.

(c) Copolymer comprising at least one compound obtained by half esterification of maleic anhydride with an alcohol containing an aromatic ring in its molecule as a monomer component and at least one styrene derivative as a monomer component.

There can be further preferably used a copolymer comprising at least one acrylic ester or methacrylic ester containing an aromatic hydrocarbon ring as a monomer component and at least one vinyl-polymerizable monomer containing an acidic functional group as a monomer component. A copolymer comprising at least one acrylic benzyl ester or methacrylic benzyl ester as a monomer component and at least one vinylpolymerizable monomer containing an acidic functional group as a monomer component can be most suitably used because these monomers are easily available. Examples of such a copolymer include methacrylic benzyl ester-methacrylic acid copolymer, methacrylic benzyl ester-acrylic acid copolymer, and acrylic benzyl ester-acrylic acid copolymer.

These resins can be used singly or in admixture. The content of such a resin is in the range of 50 to 97% by weight, preferably 70 to 95% by weight based on the weight of solid content in the photoconductive layer.

The third component which constitutes the present photoconductive layer serves as a sensitizing agent which improves the photoconductivity of a photoconductive layer comprising the above-mentioned phthalocyanine pigment and the above-mentioned binder resin. As previously mentioned, if a photoconductive layer free of any third component is used, an induction effect which causes a delay in the decay of the surface potential shortly after the irradiation with light appears, resulting in a drop in the sensitivity. The mechanism of this phenomenon is not yet made clear. It is believed that carriers generated by the irradiation with light are captured by carrier traps present on the surface of phthalocyanine grains, inhibiting the decay of the surface potential. It is believed that the present compound of the present invention serves as a sensitizing agent which reduces such an induction effect, i.e., reduces the time during which the surface potential doesn't show any decay (induction period), improving the sensitivity.

The present compound represented by the general formula (I) will be further described hereafter.

$R_1$ and $R_2$ each independently represents an alkyl group which may contain a substituent, aryl group which may contain a substituent or aralkyl group which may contain a substituent. In $R_1$ and $R_2$, the carbon number of the alkyl group is 1 to 20, preferably 1 to 12, that of the aryl group is 6 to 20, preferably 6 to 12, and that of the aralkyl group is 7 to 21, preferably 7 to 13. Examples of substituents include cyano group, hydroxyl group, carboxyl group, nitro group, halogen atom (e.g., chlorine, fluorine, or bromine), amino group, alkoxy group, aryl group, aryloxy group, alkoxycarbonyl group, acyloxy group, amino group substituted by alkyl group aryl group or aralkyl group, and trifluoromethyl group. In these substituents for $R_1$ and $R_2$, the carbon number of the alkoxy group is 1 to 20, preferably 1 to 12, that of aryl group is 6 to 20, preferably 6 to 12, that of the aryloxy group is 6 to 20, preferably 6 to 12, that of the alkoxycarbonyl group is 2 to 20, preferably 2 to 12, and that of the acyloxy group is 1 to 20, preferably 1 to 12 In the substituted amino group, the carbon number of alkyl group is 1 to 20, preferably 1 to 12, that of the aryl group is 6 to 20, preferably 6 to 12, and that of the aralkyl group is 7 to 21, preferably 7 to 13. Specific examples of $R_1$ and $R_2$ include straight-chain, branched or substituted alkyl groups such as methyl group, ethyl group, n-propyl group, iso-propyl group, n-butyl group, sec-butyl group, n-hexyl group, 2-ethylhexyl group, fluoromethyl group, chloromethyl group, trifluoromethyl group, perfluoroalkyl group, methoxymethyl group and cyanomethyl group, and aryl group, substituted aryl group, aralkyl group or substituted aralkyl group such as phenyl group, p-trifluoromethylphenyl group, o-trifluoromethylphenyl group, p-cyanophenyl group, o-cyanophenyl group, p-nitrophenyl group, o-nitrophenyl group, p-bromophenyl group, o-bromophenyl group, p-chlorophenyl group, o-chlorophenyl group, p-fluorophenyl group, o-fluorophenyl group, N,N-dimethylamido group, N,N-diethylamido group, p-carboxylphenyl group, p-methoxyphenyl group, o-methoxyphenyl group, N,N-diethylaminophenyl group, N,N-diphenylaminophenyl group, N,N-dibenzylaminophenyl group, N,N-dimethylphenyl group, naphthyl group, methoxynaphthyl group, N,N-diethylaminonaphthyl group, benzyl group, p-bromobenzyl group, p-cyanobenzyl group, p-nitrobenzyl group, p-trifluoromethylbenzyl group, o-bromobenzyl group, o-cyanobenzyl group, o-nitrobenzyl group, phenylethyl group, 3-phenylpropyl group, p-chlorobenzyl group and naphthylmethyl group. $R_1$ and $R_2$ may be the same or different.

$R_3$ represents a hydrogen atom, an alkyl group which may contain a substituent, aryl group which may contain a substituent or aralkyl group which may contain a substituent. In $R_3$, the carbon number of the alkyl group is 1 to 20, preferably 1 to 12, that of the aryl group is 6 to 20, preferably 6 to 12, and that of the aralkyl group is 7 to 21, preferably 7 to 13. Examples of substituents contained in these groups which are substituted include the same substituents as described with reference to $R_1$ and $R_2$. Specific examples of $R_3$ include hydrogen atom, straight-chain, branched or substituted alkyl group such as methyl group, ethyl group, n-propyl group, iso-propyl group, n-butyl group, sec-butyl group, n-hexyl group, 2-ethylhexyl group, fluoromethyl group, chloromethyl group, trifluoromethyl group, perfluoroalkyl group, methoxymethyl group and cyanomethyl group, and aryl group, substituted aryl group, aralkyl group or substituted aralkyl group such as phenyl group, p-trifluoromethylphenyl group, o-trifluoromethylphenyl group, p-cyanophenyl group, o-cyanophenyl group, p-nitrophenyl group, o-nitrophenyl group, p-bromophenyl group, o-bromophenyl group, p-chlorophenyl group, o-chlorophenyl group, p-fluorophenyl group, o-fluorophenyl group, N,N-dimethylamido group, N,N-diethylamido group, p-carboxylphenyl group, p-methoxyphenyl group, o-methoxyphenyl group, N,N-diethylaminophenyl group, N,N-diphenylaminophenyl group, N,N-dibenzylaminophenyl group, N,N-dimethylphenyl group, naphthyl group, methoxynaphthyl group, cyanonaphthyl group, nitronaphthyl group, chloronaphthyl group, bromonaphthyl group, fluoronaphthyl group, trifluoromethylnaphthyl group, N,N-diethylaminonaphthyl group, benzyl group, phenylethyl group, 3-phenylpropyl group, p-chlorobenzyl group, p-bromobenzyl group, p-cyanobenzyl group, p-nitrobenzyl group, p-trifluoromethylbenzyl group, o-bromobenzyl group, o-cyanobenzyl group, o-nitrobenzyl group and naphthylmethyl group.

Ar represents a monovalent aromatic hydrocarbon group (having 6 to 20 carbon atoms, preferably 6 to 12 carbon atoms) which may contain a substituent or monovalent heterocyclic group which may contain a substituent. Examples of such an aromatic hydrocarbon group or heterocyclic group include phenyl group, naphthyl group, anthranil group, furan, pyrrole, thiophene, indole, benzofuran, benzothiofuran, oxazole, imidazole, thiazole, isoxazole, pyridine, quinoline, isoquinoline, pyridazine, pyrimidine, pyrazine, phthalazine, and derivatives thereof, such as 2-thio-4-thiazolidinone, 3-pyrazolidinone, 5-isoxazolone, 2-oxazolidone, 2,4-thiazolidinedione, 2-thiophenone, 2-furanone and 4-pyrimidone. Examples of substituents which may be contained in these groups include straight-chain, branched or substituted alkyl group having 1 to 10 carbon atoms such as methyl group, ethyl group, n-propyl group, iso-propyl group, n-butyl group, sec-butyl group, n-hexyl group, 2-ethylhexyl group, fluoromethyl group, chloromethyl group, trifluoromethyl group, perfluoroalkyl group, methoxymethyl group and cyanomethyl group, unsubstituted or substituted aryl group having 6 to 10 carbon atoms, unsubstituted or substituted aralkyl group having 7 to 11 carbon atoms such as phenyl group, p-trifluoromethylphenyl group, o-cyanophenyl group, p-nitrophenyl group, p-bromophenyl group, o-bromophenyl group, o-chlorophenyl group, p-fluorophenyl group, p-methoxyphenyl group, N,N-diethylaminophenyl group, N,N-dimethylaminophenyl group, naphthyl group, methoxynaphthyl group, cyanonaphthyl group, chloronaphthyl group, benzyl group, phenylethyl group, 3-phenylpropyl group, p-chlorobenzyl group, p-cyanobenzyl group, p-nitrobenzyl group, p-trifluoromethylbenzyl group, o-bromobenzyl group, o-cyanobenzyl group, o-nitrobenzyl group, naphthylmethyl group, cyano group, hydroxyl group, carboxyl group, nitro group, halogen atom such as chlorine, fluorine and bromine, group represented by —NHCORa (in which Ra represents a substituted or unsubstituted alkyl group having 1 to 10 carbon atoms, aryl group having 6 to 10 carbon atoms or aralkyl group having 7 to 11 carbon atoms), group represented by $—NHSO_2Ra$ (in which Ra is as defined above), group represented by —SORa (in which Ra is as defined above), group represented by $—SO_2Ra$ (in which Ra is as defined above), group represented by —CORa (in which Ra is as defined above), group represented by

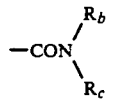

(in which $R_b$ and $R_c$ may be the same or different and each represents a hydrogen atom or substituted or unsubstituted alkyl (having 1 to 10 carbon atoms), aryl (having 6 to 10 carbon atoms) or aralkyl (having 7 to 11 carbon atoms) group), group represented by

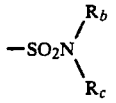

in which $R_b$ and $R_c$ are as defined above), sulfonic group, amino group, alkoxy group (having 1 to 10 carbon atoms), aryloxy group (having 6 to 10 carbon atoms), alkoxycarbonyl group (having 7 to 11 carbon atoms), acyloxy group (having 1 to 10 carbon atoms), amino group substituted by alkyl (having 1 to 10 carbon atoms), aryl (having 6 to 10 carbon atoms) or aralkyl (having 7 to 11 carbon atoms) group, and trifluoromethyl group. Of these substituents, electrophilic substituents are more preferably used than hydrogen atom.

Specific examples of the compound of the general formula (I) will be set forth below, but the present invention should not be construed as being limited thereto.

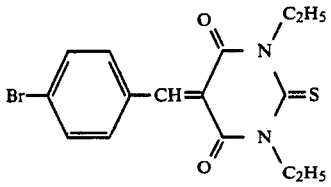

(I)-1

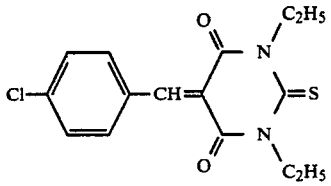

(I)-2

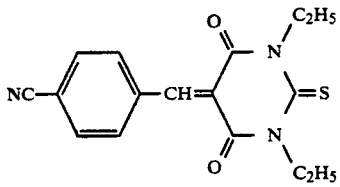

(I)-3

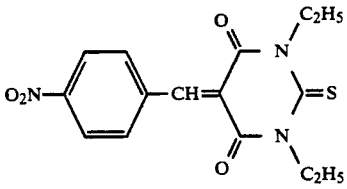

(I)-4

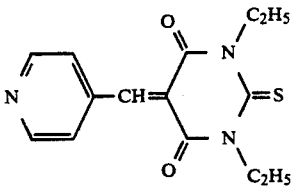

(I)-5

-continued

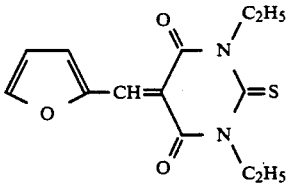

(I)-6

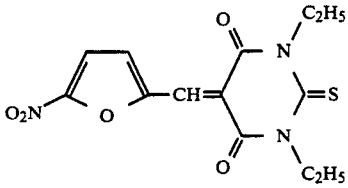

(I)-7

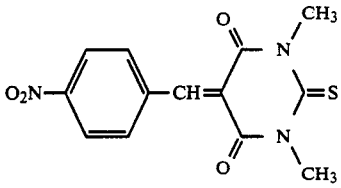

(I)-8

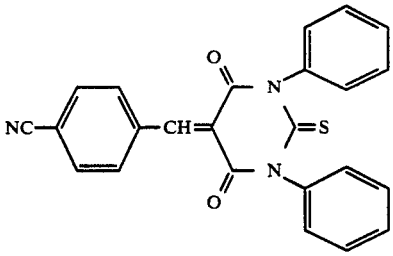

(I)-9

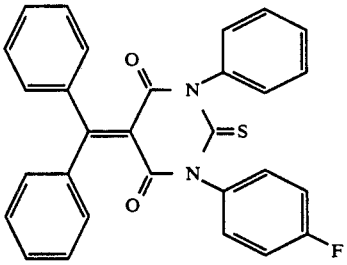

(I)-10

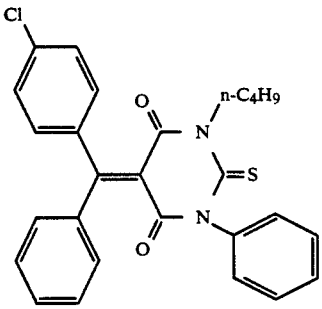

(I)-11

-continued
(I)-12
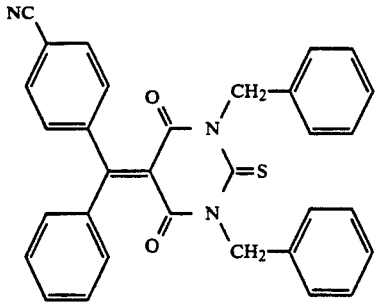
(I)-13
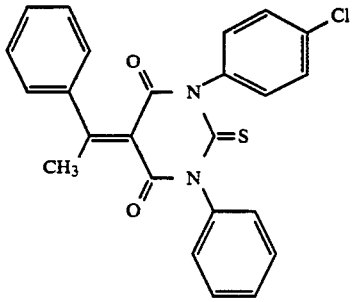
(I)-14
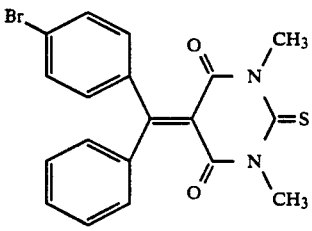
(I)-15
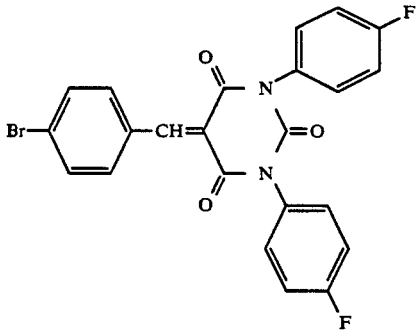
(I)-16
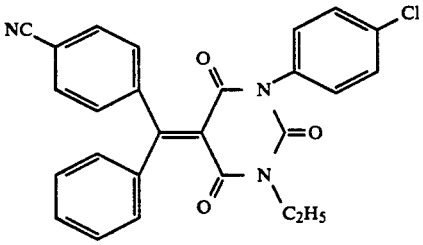
(I)-17
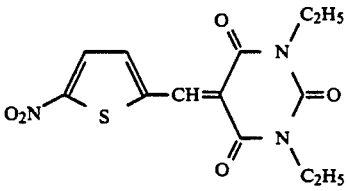
Examples of compounds wherein Ar and $R_3$ together form a ring in the general formula (I) will be set forth below, but the present invention should not be construed as being limited thereto.
(I-18)
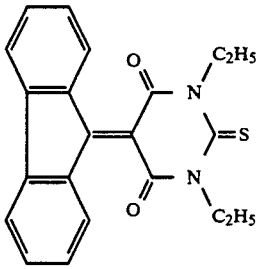
(I)-19
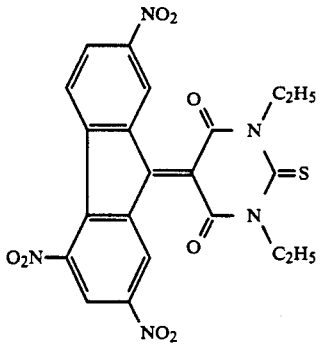
(I)-20
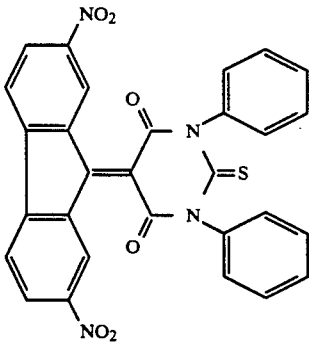
(I)-21
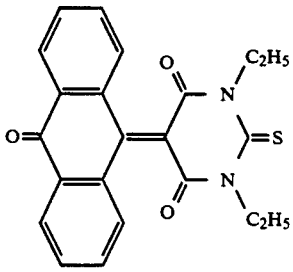

-continued (I)-22

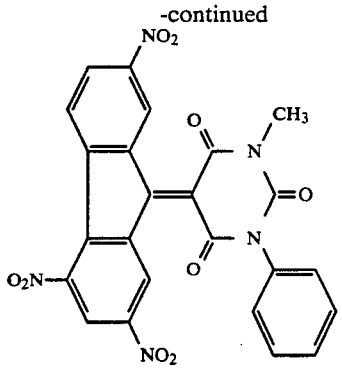

(I)-23

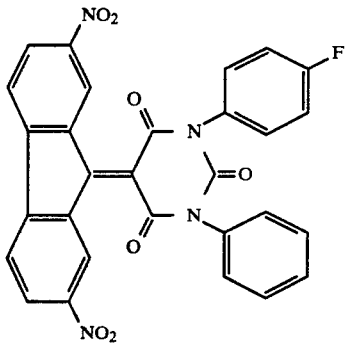

The preparation of these compounds can be easily accomplished by Knoevenagel's condensation process described in "Organic Reactions", Vol. 15, p 204–599, which comprises dehydration condensation of an aldehyde or ketone with barbituric acid or thiobarbituric acid with an alkali (e.g., NaOH, KOH, ammonia, amine such as diethylamine, triethylamine, piperidine) as a catalyst.

The use of the present compound of the general formula (I) in electrophotographic photoreceptors is described in JP-A-56-149462 and JP-A-57-29050. However, these descriptions contemplate an invention of a photoconductive polymer as a chemical sensitizer and don't contain a sensitizing effect of a photoconductive pigment. Therefore, it was not expected at all that the present compounds exhibit an effect of reducing an induction effect inherent to a phthalocyanine pigment photoreceptor of the present invention.

JP-A-57-147656 discloses the use of barbituric acid derivatives and thiobarbituric acid derivatives for electrophotographic light-sensitive printing plate materials. However, this disclosure contemplates an electrophotographic light-sensitive printing plate material comprising a hydrazone compound as an organic photoconductive compound and differs from the present invention. Thus, this disclosure doesn't contain any description of sensitization with respect to a photoconductive pigment. Therefore, it was not expected at all that the present compounds exhibit an effect of reducing an induction effect inherent to a phthalocyanine pigment photoreceptor of the present invention.

The present compounds of the general formulae (II) and (III) will be further described hereafter.

In the general formula (II) or (III), if any one of $R_4$ to $R_9$ is an alkyl group, the alkyl group may be a $C_{1-22}$ (preferably $C_{1-10}$) straight-chain or branched, substituted or unsubstituted alkyl group. Examples of substituents to be bonded to the alkyl group include halogen atom (e.g., chlorine, bromine, or fluorine), cyano group, nitro group, phenyl group, tolyl group, and trifluoromethyl group. The number of substituents to be bonded to the alkyl group is 1 to 3.

If any one of $R_4$ to $R_9$ is an aryl group, the aryl group (having 6 to 20, preferably 6 to 12 carbon atoms) may be a substituted or unsubstituted phenyl, naphthyl or anthranil group. Examples of substituents to be bonded to the phenyl, naphthyl or anthranil group include halogen atom (e.g., chlorine, bromine, or fluorine), cyano group, nitro group, trifluoromethyl group, $C_{1-5}$ straight-chain or branched alkyl group, carboxyl group, alkoxycarbonyl group, cyano group, nitro group, and $C_{1-5}$ straight-chain or branched alkyl or alkoxy group substituted by 1 or 2 or 3 same or different halogen atoms (e.g., chlorine, bromine, or fluorine). The number of substituents to be bonded to the phenyl, naphthyl or anthranil group is 1 to 3. If there are 2 or 3 substituents, they may be the same or different.

If any one of $R_4$ to $R_9$ is a monovalent group derived from a heterocyclic group, examples of the monovalent group include substituted or unsubstituted pyrrolidinyl group, piperidinyl group, piperidino group, morpholinyl group, morpholino group, pyrrolyl group, imidazolyl group, pyridyl group, pyrimidinyl group, indolinyl group, isoindolinyl group, indolyl group, isoindolyl group, benzoimidazolyl group, quinolyl group, isoquinolyl group, and monovalent group obtained by substitution of these groups by 1 or 2 or 3 same or different substituents such as halogen atom (e.g., chlorine, bromine, or fluorine), cyano group, nitro group, trifluoromethyl group, phenyl group, tolyl group, benzyl group, phenethyl group or $C_{1-5}$ straight-chain or branched alkyl group.

If $R_4$ and $R_5$ or $R_6$ and $R_7$ are connected to each other to form a divalent group, examples of such a divalent group include trimethylene group, tetramethylene group, pentamethylene group, oxydiethylene group ($-CH_{13}-CH_2-O-CH_2-CH_2-$), and divalent group obtained by substitution of 1 to 3 hydrogen atoms of these divalent groups by a halogen atom (e.g., chlorine, bromine, fluorine), cyano group, nitro group, phenyl group, tolyl group, benzyl group, phenethyl group or $C_{1-5}$ straight-chain or branched alkyl group.

If $R_{10}$ is a divalent arylene group, specific examples of such a divalent arylene group include p-phenylene group, m-phenylene group, o-phenylene group, 1,4-naphthylene group, 2,3-naphthylene group, and 4,4'-biphenylene group. If $R_{10}$ is a polymethylene group, specific examples of such a polymethylene group include $C_{1-22}$ polymethylene group. If $R_{10}$ is an alkylene group, specific examples of such an alkylene group include propylene group, butylene group, pentylidene group, 1,2-dimethylethylene group, 1,3-dimethyltrimethylene group, 1,4-dimethyltetramethylene group, 1,5-dimethylpentamethylene group, 1,6-dimethylhexamethylene group, 1-ethylethylene group, and 1,2-diethylethylene group.

If $R_{10}$ is an aralkylene group, specific examples of such an aralkylene group include

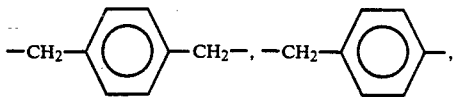

-continued

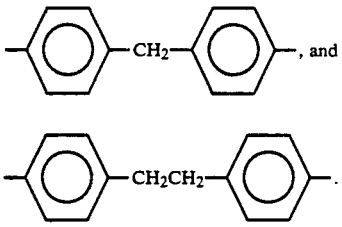

These arylene and aralkylene groups may be substituted by substituents. Examples of such substituents include halogen atom, cyano group, nitro group, trifluoromethyl group, and $C_{1-5}$ alkyl group.

Specific examples of compounds represented by the general formulae (II) and (III) will be set forth below, but the present invention should not be construed as being limited thereto.

(II)-1

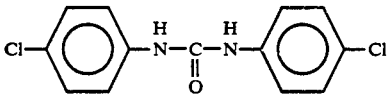

(II)-2

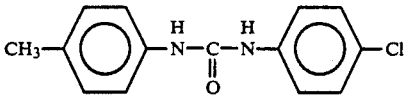

(II)-3

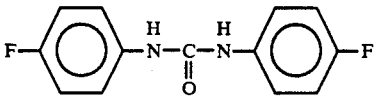

(II)-4

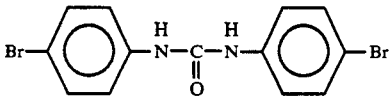

(II)-5

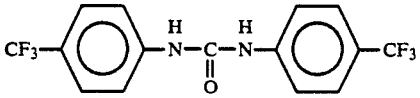

(II)-6

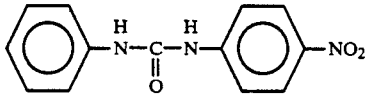

(II)-7

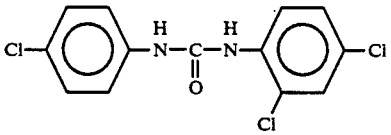

(II)-8

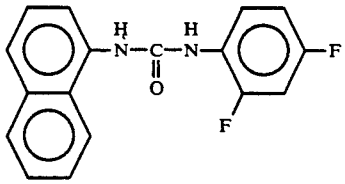

(II)-9

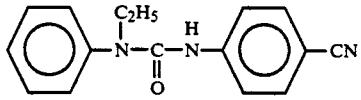

(II)-10

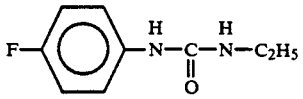

-continued
(II)-11
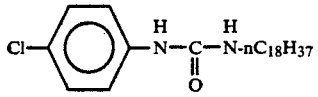
(II)-12
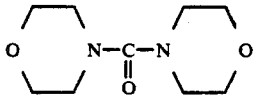
(II)-13
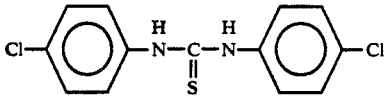
(II)-14
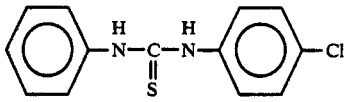
(II)-15
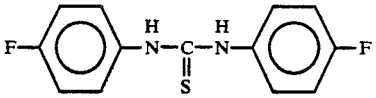
(II)-16
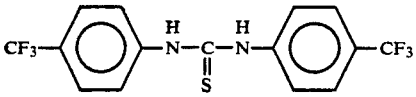
(II)-17
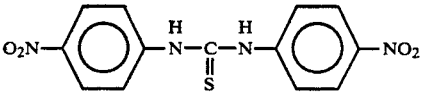
(II)-18
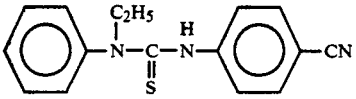
(II)-19
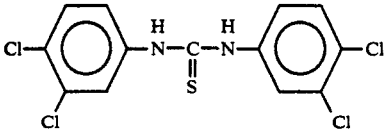
(II)-20
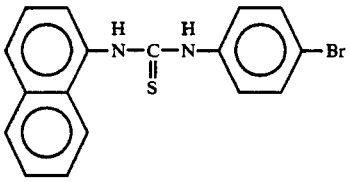
(II)-21
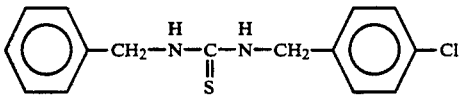
(III)-1
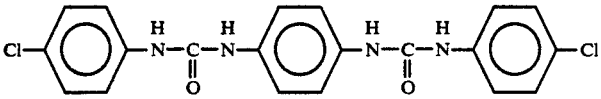
(III)-2
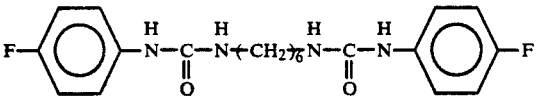

-continued

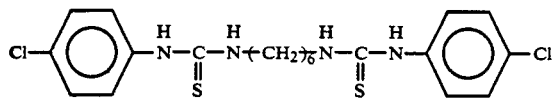

(III)-3

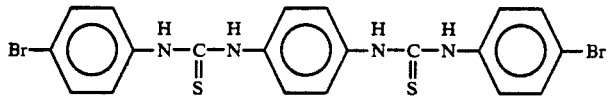

(III)-4

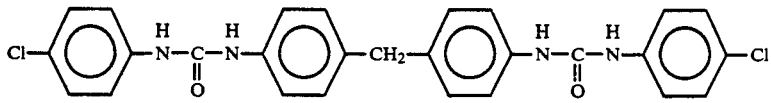

(III)-5

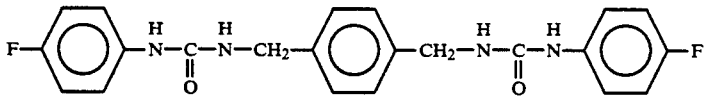

(III)-6

The synthesis of the present urea and thiourea compounds represented by the general formula (II) or (III) can be easily accomplished by an suitable methods as described in "J. Chem. Soc.", 1955, p 1573–1581.

The use of the present compounds represented by the general formula (II) or (III) for electrophotographic photoreceptors are described in JP-A-58-65438 and JP-A-58-65439. However, these descriptions are intended for the invention of a sensitizer for further sensitizing a dye-sensitized organic photoconductive material and don't refer to an effect of sensitizing a photoreceptor which has not been dye-sensitized as described herein. Furthermore, these references don't refer to the use of a phthalocyanine pigment as a photoconductive pigment as described herein. It is described in these references that ZnO is used as an inorganic photoconductive pigment. However, it was only known that inorganic photoconductive materials such as ZnO are effective when they are dye-sensitized.

It was not expected at all that the present compounds exhibit an effect of reducing an induction effect inherent to a phthalocyanine pigment photoreceptor constituting the present invention free of any organic photoconductive compound soluble in a binder resin.

The amount of the compound of the general formula (I), (II) or (III) as the third component of the present invention to be incorporated is not specifically limited but is preferably in the range of 1 to 100% by weight, more preferably 2 to 40% by weight based on the weight of phthalocyanine dye.

The photoconductive layer in the present electrophotographic printing plate precursor can comprise various known additives which have heretofore been used for electrophotographic photoreceptors besides the present compounds. As such additives there can be used chemical sensitizers for improving electrophotographic sensitivity and various plasticizers and surface active agents for improving film properties. Examples of such chemical sensitizers include electrophilic compounds such as p-benzoquinone, chloranil, fluoranil, bromanil, dinitrobenzene, anthraquinone, 2,5-dichlorobenzoquinone, nitrophenol, anhydrous tetrachlorophthalic acid, 2,3-dichloro-5,6-dicyanobenzoquinone, dinitrofluorenone and tetracyanoethylene, and compounds as described in JP-A-58-65439, JP-A-58-102239, JP-A-58-129439, and JP-A-62-71965.

Examples of plasticizers which can be added to improve the flexibility of the photoconductive layer include dimethyl phthalate, dibutyl phthalate, dioctyl phthalate, triphenyl phosphate, diisobutyl adipate, dimethyl sebacate, butyl laurate, methyl phthalyl ethyl glycolate, and dimethyl glycol phthalate. These plasticizers can be added in such a range of amount that the electrostatic property and etchability of the photoconductive layer are not deteriorated.

If the present photoconductive layer has too small a film thickness, it cannot be charged with surface potential necessary for development. On the contrary, if the present photoconductive layer has too large a film thickness, it is subject to lateral etching called side etch upon removal thereof, making it impossible to obtain an excellent printing plate. The film thickness of the photoconductive layer is preferably in the range of 0.1 to 30 μm, more preferably 0.5 to 10 μm.

As a suitable photoconductive support material for the present invention there can be used a plastic sheet having a photoconductive surface, solvent-impermeable and photo-conductive paper, and photoconductive support material having a hydrophilic surface such as aluminum plate, zinc plate, bimetal plate (e.g., copper-aluminum plate, copper-stainless steel plate, chromium-copper plate) or trimetal plate (e.g., chromium-copper-aluminum plate, chromium-lead-iron plate, chromium-copper-stainless steel plate). The thickness of such a support is preferably in the range of 0.1 to 3 mm, particularly 0.1 to 0.5 mm. Particularly preferred among these support materials is aluminum plate. As a suitable aluminum plate for the present invention there can be used a plate of pure aluminum comprising aluminum as a main component or a plate of aluminum alloy containing a slight amount of different atoms. The composition of such an aluminum plate is not specifically limited. Materials which have heretofore been known and commonly used can be properly employed in the present invention.

The aluminum plate can be grained and anodized in any known manner before use. Before being grained, the aluminum plate may be optionally degreased with a surface active agent or alkaline aqueous solution. The graining can be accomplished by mechanically roughening the surface of the material, electrochemically solving the surface of the material or chemically and selectively solving the surface of the material. The mechanical roughening can be accomplished by any known methods such as ball grinding method, brush grinding method, blast grinding method or buff grinding method. The electrochemical roughening can be effected in a hydrochloric acid or nitric acid electrolyte with an alternating current or direct current being supplied. As disclosed in JP-A-54-63902, the two processes can be used in combination.

The aluminum plate thus roughened is optionally subjected to etching with an alkali or neutralization.

The aluminum plate thus treated is then anodically oxidized. As an electrolyte to be used in the anodic oxidation there can be used sulfuric acid, phosphoric acid, chromic acid or mixtures thereof. The content and concentration of the electrolyte depend on the type of the electrolyte. The conditions under which the anodic oxidation is effected depend on the type of the electrolyte and are not specifically limited. In general, the anodic oxidation is preferably effected with an electrolyte concentration of 1 to 80% by weight at a temperature of 5° to 70° C., a current density of 5 to 60A/dm$^2$ and a voltage of 1 to 100V over 10 seconds to 50 minutes. The amount of the film obtained by the anodic oxidation is preferably in the range of 0.1 to 10 g/m$^2$, particularly 1 to 6 g/m$^2$.

As described in JP-B-47-5125, an aluminum support obtained by anodic oxidation of an aluminum plate and then dipping the material in an aqueous solution of a silicate of an alkaline metal can be preferably used. As described in U.S. Pat. No. 3,658,662, an aluminum support obtained by electro-depositing a silicate on an aluminum plate can be effectively used. A treatment with a polyvinylsulfonic acid as described in West German Patent (OLS) No. 1,621,478 can be preferably used.

In the present invention, an alkali-soluble intermediate layer comprising casein, polyvinyl alcohol, ethyl cellulose, phenolic resin, styrene-maleic anhydride copolymer, polyacrylic acid or the like can be optionally provided interposed between the electrically-conductive support and the photoconducting layer for the purpose of improving the adhesive property of the material or electrostatic property of the electrophotographic printing plate precursor.

In the present invention, an overcoat layer capable of being removed at the same time with the removal of the photoconductive layer can be optionally provided on the photoconductive layer for the purpose of improving the electrostatic property, the developability upon toner development, the image property, the printability or the like. The overcoat layer may be a mechanically matted layer or a resin layer containing a matt agent. Examples of such a matt agent include silicon dioxide, glass grain, alumina, starch, titanium oxide, zinc oxide, grain of polymer such as polymethyl methacrylate, polystyrene or phenol resin, and matt agent as described in U.S. Pat. Nos. 2,701,245, and 2,992,101. These matt agents can be used in combination. The resin to be incorporated in the overcoat layer there can be properly selected depending on the etching solution to be used in combination for the removal of the photoconductive layer. Specific examples of such a resin include gum arabic, glue, cellulose, starch, polyvinyl alcohol, polyethylene oxide, polyacrylic acid, polyacrylamide, polyvinyl methyl ether, epoxy resin, phenolic resin, polyamide, and polyvinyl butyral. These resins can be used in combination.

As a toner to be used in the present invention there can be used any electrophotographic toner such as dry developer or liquid developer so long as it has resistance to the etching solution which removes a nonimage portion and serves to prevent the etching solution from eluting the photoconductive layer in the toner image portion. In order to obtain a high resolution image, a liquid developer is preferably used. Further preferably, a toner which can provide a hydrophobic and ink-acceptable toner image can be used. Examples of toner grain to be incorporated in such a toner include high molecular compounds such as homopolymer and copolymer of polystyrene resin, polyvinyl toluene resin, polyester resin and acryl ester, homopolymer and copolymer of methacryl ester, ethylene copolymer, cyclized rubber, homopolymer and copolymer of vinyl acetate, and vinyl chloride. A pigment or dye such as carbon black, nigrosine pigment, phthalocyanine blue, phthalocyanine green, benzidine yellow, alkali blue, carmine 6B can be incorporated in the toner so long as it doesn't adversely affect the fixability, dispersibility and etching resistance of the toner. Furthermore, various charging adjusters or other additives can be incorporated in the toner.

As an etching solution to be used for the removal of a photoconductive insulating layer in the toner image portion after the formation of a toner image there can be used any solvent which can remove a photoconductive insulating layer. Such a solvent is not specifically limited. Preferably, an alkaline solvent can be used in the present invention. The term "alkaline solvent" as used herein means an aqueous solution containing an alkaline compound, an organic solvent containing an alkaline compound or a mixture thereof. Examples of such an alkaline compound include organic and inorganic alkaline compounds such as sodium hydroxide, potassium hydroxide, sodium carbonate, sodium silicate, potassium silicate, sodium metasilicate, potassium metasilicate, sodium phosphate, potassium phosphate, ammonia, monoethanolamine, diethanolamine, triethanolamine and other aminoalcohols. As described above, water or any organic solvent can be used as a solvent for the etching solution. An etching solution comprising water as a main component is preferably used in the light of odor and environmental pollution. Such an etching solution can optionally comprise various organic solvents. Preferred examples of such organic solvents include lower alcohol or aromatic alcohol such as methanol, ethanol, propanol, butanol, benzyl alcohol and phenethyl alcohol, ethylene glycol, diethylene glycol, triethylene glycol, polyethylene glycol, Cellosolve, and aminoalcohol such as monoethanolamine, diethanolamine and triethanolamine. Furthermore, the etching solution can comprise a surface active agent, antifoaming agent, and optionally various additives.

The process for the preparation of a printing plate from the present electrophotographic printing plate precursor will be described hereinafter. Any suitable known electrophotographic process can be used to form an image on the present electrophotographic printing plate precursor. Specifically, the electrophotographic printing plate precursor is essentially uniformly charged in a dark place, and then imagewise exposed to light to form a latent image thereon. Examples of exposure process include reflective imagewise exposure with a xenon lamp, tungsten lamp or fluorescent tube as a light source, close contact exposure through a transparent positive film, and scanned exposure by a laser, light-emitting diode or the like. For the scanned exposure, laser such as helium-neon laser, helium-cadmium laser, argon ion laser, krypton ion laser, YAG laser, ruby laser, nitrogen laser, dye laser, exciter laser, semiconductor laser such as GaAs/GaAlAs, InGaAs laser, alexandrite laser, copper vapor laser or erbium laser, light-emitting laser or liquid crystal shutter (including light source for line printer using a light-emitting diode array, liquid crystal shutter arrary or the like) can be used.

The latent image thus formed is then developed with a toner. The development can be accomplished by either dry development process (e.g., cascade development, magnetic brush development, powder cloud development) or liquid development. Among these development processes, the liquid development, which enables the formation of a fine image, can be preferably used for the preparation of a printing plate. Furthermore, the positive-positive development process by positive development or the negative-positive development process by reversal development comprising application of a proper bias voltage can be used in the present invention. The toner image thus developed can be fixed by any suitable fixing process such as heating fixing, pressure fixing or solvent fixing. With the toner image thus fixed as a resist, the photoconductive layer in the nonimage portion is removed by an etching solution to obtain a printing plate.

The present invention will be further described in the following examples, but the present invention should not be construed as being limited thereto. The amount of each component is represented in parts by weight.

| EXAMPLE 1 | |
|---|---|
| ε-type copper phthalocyanine (Liophoton ERPC; Toyo Ink Mfg. Co., Ltd.) | 3.0 |
| Exemplary Compound (I)-1 | 0.3 |
| Methacrylic benzyl-methacrylic acid copolymer (monomer composition ratio: 60:40 (molar ratio)) | 15.0 |
| Tetrahydrofuran | 100 |
| Cyclohexanone | 20 |

The above described materials were charged into a 500-ml glass container with glass beads. The materials were then subjected to dispersion in a paint shaker (produced by Toyo Seiki Seisakusho K.K.) over 120 minutes. The glass beads were then filtered off to obtain a dispersion for a photoconductive layer.

The dispersion was then coated onto a 0.25-mm thick grained aluminum plate, and dried to prepare an electrophotographic printing plate precursor comprising a photo-conductive layer having a dried film thickness of 5.0 μm.

The electrophotographic printing plate precursor thus prepared was then measured for electrophotographic sensitivity. The electrophotographic printing plate precursor was then corona-charged at +8.0 kV in a static process by means of an electrostatic copying paper tester EPA-8100 (produced by Kawaguchi Denki K.K.), exposed to monochromatic light with a wavelength of 780 nm and an intensity of 10 mW/m$^2$, and measured for electrophotographic properties in the following manner.

The electrophotographic properties determined were surface potential (V0) shortly after charging, percentage charge retention rate (DD30) as ratio of surface potential 30 seconds after charging to V0, and exposure (E50) such that the surface potential before exposure is attenuated to one half and exposure (E80) such that the surface potential before exposure is attenuated to one fifth.

The results were as follows:

| | |
|---|---|
| V0 | +455 V |
| E50 | 5.1 μJ/cm$^2$ |
| E80 | 6.7 μJ/cm$^2$ |
| DD30 | 92% |

The specimen was then charged at a surface potential of +450V in a dark place, exposed to 780-nm light from a semiconductor laser in such a manner that the exposure at the surface thereof was 5.0 μJ/cm$^2$, and developed at a bias voltage of 40V applied to an opposing electrode with a liquid developer prepared by dispersing 5 g of polymethyl methacrylate grains (grain size: 0.3 μm) as toner grains in 1 liter of Isoper H (Esso Standard) and adding 0.01 g of soybean oil lecithin to the material. Thus, a sharp positive toner image was obtained.

The specimen was then heated at a temperature of 120° C. over 30 seconds to fix the toner image. The nonimage portion on the electrophotographic printing plate precursor was removed with an etching solution obtained by diluting 40 parts of potassium silicate, 10 parts of potassium hydroxide and 100 parts of ethanol with 800 parts of water. The electrophotographic printing plate was then thoroughly washed with water, and rubberized to prepare an offset printing plate.

The printing plate thus prepared was then used in an ordinary printing by means of Hamada Star 600 CD offset printer. As a result, 50,000 sheets of very sharp printed materials were obtained without stain in the nonimage portion.

The specimen could also be used with little or no problem after storage over 3 months at a temperature of 35° C. and a relative humidity of 80%.

EXAMPLE 2

An electrophotographic printing plate precursor was prepared in the same manner as in Example 1 except that Exemplary Compound (II)-1 was used instead of Exemplary Compound (I)-1 in the same amount. The specimen was measured for electrophotographic properties in the same manner as in Example 1. The results were as follows:

| | |
|---|---|
| V0 | +455 V |
| E50 | 3.5 μJ/cm$^2$ |
| E80 | 5.2 μJ/cm$^2$ |
| DD30 | 90% |

The specimen was then charged at a surface potential of 450V in a dark place, exposed to 780-nm light from a semiconductor laser in such a manner that the exposure at the surface thereof was 5.0 μJ/cm$^2$, and developed at a bias voltage of 40V applied to an opposing electrode with a liquid developer prepared by dispersing 5 g of polymethyl methacrylate grains (grain size: 0.3 μm) as toner grains in 1 liter of Isoper H (Esso Standard) and adding 0.01 g of soybean oil lecithin to the material. Thus, a sharp positive toner image was obtained.

The specimen was then heated at a temperature of 120° C. over 30 seconds to fix the toner image. The nonimage portion on the electrophotographic printing plate precursor was removed with an etching solution obtained by diluting 40 parts of potassium silicate, 10 parts of potassium hydroxide and 100 parts of ethanol with 800 parts of water. The electrophotographic printing plate was then thoroughly washed with water, and rubberized to prepare an offset printing plate.

The printing plate thus prepared was then used in an ordinary printing by means of Hamada Star 600 CD offset printer. As a result, 50,000 sheets of very sharp printed materials were obtained without stain in the nonimage portion.

The specimen could also be used with little or no problem after storage over 3 months at a temperature of 35° C. and a relative humidity of 80%.

COMPARATIVE EXAMPLE 1

For comparison, an electrophotographic printing plate precursor was prepared in the same manner as in Examples 1 and 2 except that Exemplary Compounds (I)-1 and (II)-1 were not incorporated therein. The specimen was then measured for electrophotographic properties in the same manner as in Examples 1 and 2. The results were as follows:

| | |
|---|---|
| V0 | +445 V |
| E50 | 9.0 μJ/cm² |
| E80 | 10.6 μJ/cm² |
| DD30 | 93% |

The results show that the specimen exhibits a greater induction effect than the specimens of Examples 1 and 2 and exhibits a poor sensitivity.

COMPARATIVE EXAMPLE 2

An electrophotographic printing plate precursor was prepared in the same manner as in Examples 1 and 2 except that 5 parts of the following hydrazone compound was incorporated as an organic photoconducting compound instead of Exemplary Compounds (I)-1 and (II)-2. The specimen was then measured for electrophotographic properties in the same manner as in Examples 1 and 2.

Hydrazone Compound

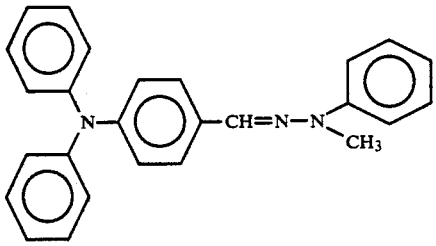

The results were as follows:

| | |
|---|---|
| V0 | +380 V |
| E50 | 3.5 μJ/cm² |
| E80 | 12.6 μJ/cm² |
| DD30 | 75% |

The results show that the specimen exhibits poor chargeability and charge retention capability. While the specimen doesn't exhibit an induction effect, it shows a slow attenuation of surface potential and hence a low tone reproducibility. The specimen was poorer in E80 as a measure of the practical sensitivity than that in Examples 1 and 2.

The specimen was then charged at a surface potential of +390V in a dark place, and exposed to 780-nm light from a semiconductor laser in such a manner that the exposure at the surface thereof was 10.0 μJ/cm².

The specimen was then subjected to toner development and etching and used in printing in the same manner as in Examples 1 and 2. As a result, a printed material with stains in places was obtained.

After being stored at a temperature of 35° C. and a relative humidity of 80% over 3 months, the specimen was observed with the hydrazone compound as an organic photoconductive compound deposited on the surface thereof.

Figure 2:
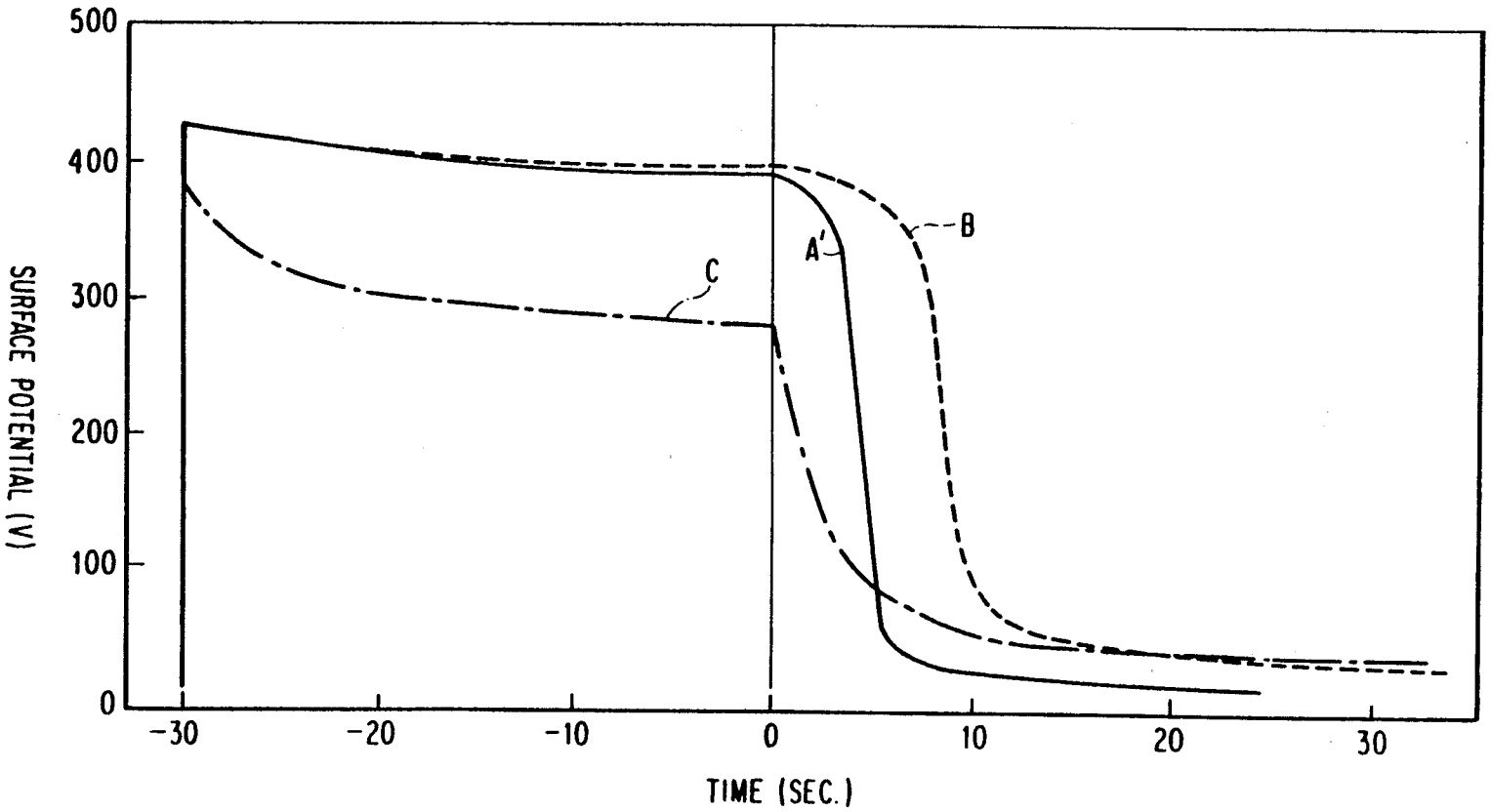

The measurements of the electrophotographic properties of the electrophotographic printing plate precursor in Examples 1 and 2 and Comparative Examples 1 and 2 as determined by the method described in Example 1 are set forth in FIGS. 1 and 2. In FIG. 1, A, B and C indicate the surface potential attenuation curve of the electrophotographic printing plate precursors in Example 1 and Comparative Examples 1 and 2, respectively. In FIG. 2, A', B and C indicate the surface potential attenuation curve of the electrophotographic printing plate precursors in Example 2 and Comparative Examples 1 and 2, respectively.

In FIGS. 1 and 2, the curves indicate a dark attenuation of surface potential between −30 seconds and 0 second and a light attenuation of surface potential between 0 second and 30 seconds.

The results in FIGS. 1 and 2 show that the electrophotographic printing plate precursors in Examples 1 and 2 exhibit a lower induction effect (shorter period during which the surface potential is hardly attenuated at the initial stage of attenuation) than that in Comparative Example 1. Furthermore, no deterioration in chargeability and charge retention capability due to the addition of Exemplary Compounds (I)-1 and (II)-1 was recognized. The hard contrast was not impaired by the addition of Exemplary Compounds (I)-1 and (II)-1.

While the specimen in Comparative Example 2 doesn't exhibit an induction effect, it shows a slow light attenuation and a lower practical sensitivity than that of the electrophotographic printing plate precursors in Examples 1 and 2. Furthermore, the specimen in Comparative Example 2 exhibits poor chargeability and charge retention capability.

EXAMPLES 3-10

Electrophotographic printing plate precursors were prepared in the same manner as in Example 1 except that compounds shown in Table 1 were used instead of Exemplary Compound (II)-1, respectively. These specimens were then measured for electrophotographic properties in the same manner as in Example 1. The results are set forth in Table 1.

TABLE 1

| | Exemplary Compound | V0 (V) | DD30 (%) | E50 (μJ/cm²) | E80 (μJ/cm²) |
|---|---|---|---|---|---|
| Example 3 | (I)-2 | 460 | 93 | 5.2 | 6.9 |
| Example 4 | (I)-3 | 452 | 92 | 5.1 | 6.5 |
| Example 5 | (I)-7 | 447 | 91 | 5.6 | 7.2 |
| Example 6 | (I)-10 | 450 | 93 | 5.1 | 6.6 |
| Example 7 | (I)-13 | 448 | 92 | 5.4 | 6.9 |
| Example 8 | (I)-15 | 445 | 93 | 5.3 | 7.0 |
| Example 9 | (I)-19 | 439 | 90 | 5.2 | 6.7 |

TABLE 1-continued

| | Exemplary Compound | V0 (V) | DD30 (%) | E50 ($\mu J/cm^2$) | E80 ($\mu J/cm^2$) |
|---|---|---|---|---|---|
| Example 10 | (I)-23 | 441 | 92 | 5.8 | 7.1 |

EXAMPLES 11-18

Electrophotographic printing plate precursors were prepared in the same manner as in Example 2 except that compounds shown in Table 2 were used instead of Exemplary Compound (II)-1, respectively. These specimens were then measured for electrophotographic properties in the same manner as in Example 1. The results are set forth in Table 2.

TABLE 2

| | Exemplary Compound | V0 (V) | DD30 (%) | E50 ($\mu J/cm^2$) | E80 ($\mu J/cm^2$) |
|---|---|---|---|---|---|
| Example 11 | (II)-2 | 455 | 92 | 5.4 | 6.5 |
| Example 12 | (II)-3 | 457 | 90 | 3.7 | 5.4 |
| Example 13 | (II)-4 | 440 | 91 | 4.0 | 5.8 |
| Example 14 | (II)-5 | 430 | 90 | 3.8 | 5.3 |
| Example 15 | (II)-8 | 440 | 92 | 4.8 | 5.8 |
| Example 16 | (III)-2 | 455 | 91 | 5.3 | 6.2 |
| Example 17 | (II)-13 | 429 | 90 | 6.0 | 7.5 |
| Example 18 | (III)-6 | 431 | 92 | 5.5 | 7.0 |

EXAMPLE 19

An electrophotographic printing plate precursor was prepared in the same manner as in Example 1 except that x type metal-free phthalocyanine (Fastogen Blue 8120; Dainippon Ink and Chemicals, Inc.) was used as a phthalocyanine pigment instead of $\epsilon$ type copper-containing phthalocyanine. The electrophotographic printing plate precursor thus prepared was then measured for electrophotographic properties in the same manner as in Example 1. The results were as follows:

| | |
|---|---|
| V0 | +440 V |
| E50 | 1.1 $\mu J/cm^2$ |
| E80 | 1.2 $\mu J/cm^2$ |
| DD30 | 92% |

The specimen was then charged at a surface potential of 450V in a dark place, exposed to 780-nm light from a semiconductor laser in such a manner that the exposure at the surface thereof was 2.0 $\mu J/cm^2$, and toner-developed in the same manner as in Example 1. The specimen was then used in an etching printing in the same manner as in Example 1. As a result, 50,000 sheets of very sharp printed materials were obtained without stain in the nonimage portion.

The specimen could also be used with little or no problem after storage over 3 months at a temperature of 35° C. and a relative humidity of 80%.

EXAMPLE 20

An electrophotographic printing plate precursor was prepared in the same manner as in Example 1 except that x type metal-free phthalocyanine (Fastogen Blue 8120; Dainippon Ink and Chemicals, Inc.) was used as a phthalocyanine pigment instead of $\alpha$ type copper-containing phthalocyanine and a vinyl benzoate-crotonic acid copolymer (monomer composition ratio: 60:40 (molar ratio)) was used as a binder resin instead of the methacrylic benzyl ester-methacrylic acid copolymer. The electrophotographic printing plate precursor thus prepared was then measured for electrophotographic properties in the same manner as in Example 1. The results were as follows:

| | |
|---|---|
| V0 | +430 V |
| E50 | 1.2 $\mu J/cm^2$ |
| E80 | 1.3 $\mu J/cm^2$ |
| DD30 | 90% |

The specimen was then charged at a surface potential of 450V in a dark place, exposed to 780-nm light from a semiconductor laser in such a manner that the exposure at the surface thereof was 3.0 $\mu J/cm^2$, and toner-developed in the same manner as in Example 1. The specimen was then used in an etching printing in the same manner as in Example 1. As a result, 50,000 sheets of very sharp printed materials were obtained without stain in the nonimage portion.

The specimen could also be used with little or no problem after storage over 3 months at a temperature of 35° C. and a relative humidity of 80%.

EXAMPLE 21

An electrophotographic printing plate precursor was prepared in the same manner as in Example 2 except that x type metal-free phthalocyanine (Fastogen Blue 8120; Dainippon Ink and Chemicals, Inc.) was used as a phthalocyanine pigment instead of type copper-containing phthalocyanine. The electrophotographic printing plate precursor thus prepared was then measured for electrophotographic properties in the same manner as in Example 1. The results were as follows:

| | |
|---|---|
| V0 | +440 V |
| E50 | 0.9 $\mu J/cm^2$ |
| E80 | 1.0 $\mu J/cm^2$ |
| DD30 | 92% |

The specimen was then charged at a surface potential of 450V in a dark place, exposed to 780-nm light from a semiconductor laser in such a manner that the exposure at the surface thereof was 2.0 $\mu J/cm^2$, and toner-developed in the same manner as in Example 2. The specimen was then used in an etching printing in the same manner as in Example 2. As a result, 50,000 sheets of very sharp printed matters were obtained without stain in the nonimage portion.

The specimen could also be used with little or no problem after storage over 3 months at a temperature of 35° C. and a relative humidity of 80%.

EXAMPLE 22

An electrophotographic printing plate precursor was prepared in the same manner as in Example 2 except that x type metal-free phthalocyanine (Fastogen Blue 8120; Dainippon Ink and Chemicals, Inc.) was used as a phthalocyanine pigment instead of type copper-containing phthalocyanine and a vinyl benzoate-crotonic acid copolymer (monomer composition ratio: 60:40 (molar ratio)) was used as a binder resin instead of the methacrylic benzyl ester-methacrylic acid copolymer. The electrophotographic printing plate precursor thus prepared was then measured for electrophotographic properties in the same manner as in Example 1. The results were as follows:

| | |
|---|---|
| V0 | +420 V |
| E50 | 1.1 $\mu J/cm^2$ |
| E80 | 1.3 $\mu J/cm^2$ |
| DD30 | 90% |

The specimen was then charged at a surface potential of 450V in a dark place, exposed to 780-nm light from a semiconductor laser in such a manner that the exposure at the surface thereof was 3.0 $\mu J/cm^2$, and toner-developed in the same manner as in Example 2. The specimen was then used in an etching printing in the same manner as in Example 2. As a result, 50,000 sheets of very sharp printed materials were obtained without stain in the nonimage portion.

The specimen could also be used with little or no problem after storage over 3 months at a temperature of 35° C. and a relative humidity of 80%.

In accordance with the present invention, an electrophotographic printing plate precursor with a high sensitivity, excellent chargeability, excellent charge retention capability in dark place, and high tone reproducibility which can be advantageously used as a photoreceptor for printing plate material can be obtained. The electrophotographic printing plate precursor according to the present invention is excellent in elutability by an etching solution and stability with time.

While the invention has been described in detail and with reference to specific embodiments thereof, it will be apparent to one skilled in the art that various changes and modifications can be made therein without departing from the spirit and scope thereof.

What is claimed is:

1. An electrophotographic printing plate precursor comprising an electrically-conductive support having thereon a photoconductive layer containing at least photoconductive pigments and a binder resin which is designed to undergo an electrophotographic process wherein a toner image is formed and the photoconductive layer in the nonimage portion other than the toner image portion is then removed to form a printing plate, wherein said photoconductive pigments are phthalocyanine pigments and said photoconductive layer further comprises a compound represented by the general formula (I), (II) or (III):

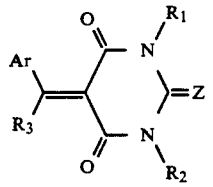

(I)

wherein Z represents a sulfur or oxygen atom; Ar represents a monovalent aromatic hydrocarbon group or monovalent heterocyclic group; $R_3$ represents a hydrogen atom, alkyl group, aryl group or aralkyl group; Ar and $R_3$ may together form a ring; and $R_1$ and $R_2$, which may be the same or different, each represents an alkyl group, aryl group or aralkyl group, with the proviso that the aromatic hydrocarbon group and heterocyclic group represented by Ar and the alkyl, aryl and aralkyl group represented by $R_1$, $R_2$ and $R_3$ may be further substituted by substituents,

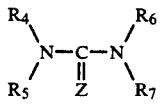

(II)

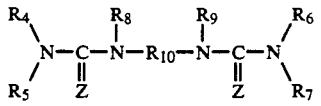

(III)

wherein Z represents a sulfur or oxygen atom; $R_4$ to $R_9$, which may be the same or different, each represents a hydrogen atom, alkyl group, aryl group or monovalent group derived from a heterocyclic group; $R_4$ and $R_5$ or $R_6$ and $R_7$ may be connected to each other; $R_4$ to $R_7$ may be connected to each other to form a crosslinkable ring as a whole in the general formula (II); and $R_{10}$ represents a divalent arylene, aralkylene, polymethylene or alkylene group.

2. An electrophotographic printing plate precursor as claimed in claim 1, wherein said binder resin is a copolymer comprising at least one aromatic ring-containing acrylic or methacrylic ester as a monomer component and at least one acidic functional group-containing a vinyl-polymerizable monomer as a monomer component, a copolymer comprising at least one aromatic ring-containing vinyl ester compound as a monomer component and at least one acidic functional group-containing vinyl-polymerizable monomer as a monomer component or a copolymer comprising at least one compound obtained by half esterification of maleic anhydride with an alcohol containing an aromatic ring in its molecule as a monomer component and at least one styrene derivative as a monomer component.

3. An electrophotographic printing plate precursor as claimed in claim 1, wherein said phthalocyanine pigments are x-type metal-free phthalocyanines.

4. An electrophotographic printing plate precursor as claimed in claim 1, wherein the compound of formula (I), (II) or (III) is incorporated in an amount of from 1 to 100% by weight based on the weight of the phthalocyanine dye.

5. An electrophotographic printing plate precursor as claimed in claim 1, wherein said photoconductive layer comprises photoconductive compounds other than phthalocyanine pigment in an amount of 50% or less based on the total weight of the photoconductive layer.

6. An electrophotographic printing plate precursor as claimed in claim 1, wherein said photoconductive layer comprises photoconductive compounds other than phthalocyanine pigment in an amount of 30% or less based on the total weight of the photoconductive layer.

7. An electrophotographic printing plate precursor as claimed in claim 1, wherein said phthalocyanine pigment has an absorption in the range of from 780 nm to 830 nm.

8. An electrophotographic printing plate precursor as claimed in claim 1, wherein Ar represents a group selected from phenyl, naphthyl, anthranil, furan, pyrrole, thiophene, indole, benzofuran, benzothiofuran, oxazole, imidazole, thiazole, isoxazole, pyridine, quinoline, isoquinoline, pyridazine, pyrimidine, pyrazine, phthalazine, and derivatives thereof, each of which may contain a substituent or monovalent heterocyclic group which may contain a substituent.

9. A process for forming an image, comprising charging an electrophotographic printing plate precursor as claimed in claim 1, exposing said printing plate precursor to actinic radiation in the range of from 780 to 830 mn, subjecting to toner development, and etching.

* * * * *